US007305849B2

(12) United States Patent
Löffler et al.

(10) Patent No.: US 7,305,849 B2
(45) Date of Patent: Dec. 11, 2007

(54) SORPTIVE HEAT EXCHANGER AND RELATED COOLED SORPTION PROCESS

(75) Inventors: Michael Karl Löffler, Karlsruhe (DE); Hans-Martin Henning, Freiburg (DE)

(73) Assignee: Mario Gualtiero Francesco Motta, Catania (IT)

( * ) Notice: Subject to any disclaimer, the term of this patent is extended or adjusted under 35 U.S.C. 154(b) by 214 days.

(21) Appl. No.: 10/513,866

(22) PCT Filed: May 9, 2003

(86) PCT No.: PCT/EP03/05002

§ 371 (c)(1),
(2), (4) Date: Jul. 25, 2005

(87) PCT Pub. No.: WO03/095917

PCT Pub. Date: Nov. 20, 2003

(65) Prior Publication Data

US 2006/0048538 A1 Mar. 9, 2006

(30) Foreign Application Priority Data

May 10, 2002 (DE) ..... 102 20 631

(51) Int. Cl.
*F25B 17/08* (2006.01)
*F25B 17/00* (2006.01)

(52) U.S. Cl. ..... 62/480; 62/481; 62/483

(58) Field of Classification Search ..... 62/94, 62/101, 112, 434, 467, 476, 480, 481, 483; 95/114

See application file for complete search history.

(56) References Cited

U.S. PATENT DOCUMENTS

| | | | | |
|---|---|---|---|---|
| 4,393,924 | A | 7/1983 | Asami et al. | |
| 5,046,247 | A | 9/1991 | Oguro et al. | |
| 5,186,020 | A * | 2/1993 | Rockenfeller et al. | 62/457.9 |
| 5,212,956 | A * | 5/1993 | Tsimerman | 62/94 |
| 5,440,889 | A | 8/1995 | Sippel et al. | |
| 5,441,716 | A | 8/1995 | Rockenfeller | |
| 5,515,695 | A * | 5/1996 | Sakakibara et al. | 62/202 |
| 5,606,870 | A * | 3/1997 | Lester | 62/434 |
| 5,813,248 | A | 9/1998 | Zornes et al. | |
| 5,875,648 | A * | 3/1999 | Boye et al. | 62/480 |
| 2003/0015093 | A1 * | 1/2003 | Wegeng et al. | 95/114 |
| 2003/0086701 | A1 * | 5/2003 | Motz | 392/479 |

FOREIGN PATENT DOCUMENTS

| | | |
|---|---|---|
| DE | 198 00 395 | 7/1999 |
| JP | 62-258996 | 4/1988 |
| JP | 11-101473 A * | 4/1999 |

* cited by examiner

*Primary Examiner*—Mohammad M. Ali
(74) *Attorney, Agent, or Firm*—Hedman & Costigan P.C.; James V. Costigan

(57) ABSTRACT

A sorptive heat exchanger (E), which presents a plurality of heat exchange channels (10) in thermal contact with respective sorption channels (11), where sorption material (12) is fixed on the internal surfaces of channels (11).

19 Claims, 5 Drawing Sheets

SORPTIVE HEAT EXCHANGER AND RELATED COOLED SORPTION PROCESS

The present invention relates to a sorptive heat exchanger and related cooled sorption process.

Particularly the invention relates to an equipment where a cooled sorption process takes place on a solid sorption material and to the related cooled sorption process on a solid sorption material.

In various industrial applications a sorption process is used in order to eliminate or reduce the presence of at least one component from a gas mixture for example wet gas used in an industrial process from which a liquid must be extracted.

In the case of air, i.e. gas mixture including water vapour, during air conditioning, cooling and dehumidification processes take place. The air dehumidification implies the partial extraction of the gas component water vapour from the air. Therefore the cooled sorption process of water vapour from air on a solid sorption material, could be used for air conditioning purposes, extracting the water vapour (i.e. dehumidifying) from the air stream.

Half of the energy consumption of office buildings is due to air conditioning. In the last years, air conditioning plants using solar energy and employing sorption components have been developed, built, and monitored. For example, sorption processes were implemented in thermodynamic open cycles (Desiccant and Evaporative cooling, DEC plants), where the sorption material is regenerated, by means of desorption process, using the thermal energy produced for instance with solar collectors. Many refrigerant compounds are hazardous for the environment, on the contrary water used as refrigerant does not cause any risks for the atmosphere. The sorption material regeneration is carried out by means of a warm air stream, which can come, for example, from solar air collectors. In a successive phase the regenerated sorption material dehumidifies the external air that is then further cooled and humidified and then blown into the building. In order to realise the open cycle, up to now the sorption material is regenerated with hot air and then brought into contact with external air causing its dehumidification. FIG. 1 presents the layout of a conventional DEC plant according to prior art. In the simplified scheme ambient air 1 flows through the sorption wheel SR. The ambient air is dehumidified and heated in the SR. The air is then blown towards position 2. Afterwards the air reaches the heat recovery wheel WR, in which the air is cooled down. The air, which leaves the wheel WR by means of the channel 3, is further cooled down by means of humidification in the humidifier 4 using the effect of evaporative cooling and afterwards the air is transferred into the interior of the building. In the interior of the building the air takes up humidity M and heat Q. The air leaves the interior building 5 and is again humidified and cooled down in the humidifier 6. In the heat recovery wheel WR the air takes up heat and then reaches the channel 7. In a heating unit which is preferably a solar heating unit 8 (e.g. solar air heating collector) the air is further heated and is afterwards transferred to the sorption wheel SR. In the SR the hot air dries the sorption material. The air leaves the sorption wheel SR warm and humid, by means of a channel 9.

This kind of plant, where the rotary dehumidifiers technology is used, results economically feasible only if their size is bigger than about 10.000 $m^3/h$. In sorption air conditioning systems, where the air treatment takes place in a heat exchanger, the process is optimised, costs are reduced and it is advantageous to realise sorptive air conditioning systems even of small size (air volume flow considerably lower than 10.000 $m^3/h$).

The process implementation of conventional sorption air conditioning plants, as the one described in FIG. 1, faces problems, which are not solved in a satisfying way yet. This becomes obvious at two states in the physical process.

The sorption rotor (desiccant wheel) is heated up remarkably after thermal desorption. This heat is an obstacle in the subsequent adsorption step, i.e. the step of water uptake, because the sorption material can take up less amount of water from the incoming air stream at higher temperatures. The sorption potential (and thereby the cooling capacity) would be higher, if the sorption material would be cooled during the sorption process.

When ambient air gets in the sorption rotor humidity from the ambient air is taken up. Thereby chemical heat is set free leading to a temperature increase of the sorption material. This heat is taken up from the streaming air and is transported in direction of the stream. The sorption material following in the direction of the stream takes up part of this heat. This again leads to a reduction of the potential for uptake (sorption) of the sorption material. Besides this the air is heated up in an unfavourable way since this contradicts to the main purpose of the entire process, namely cooling of the air.

Again, it is more favourable, if the sorption material is cooled during the sorption process and remains on a lower temperature level. Thereby also the temperature of the air leaving the process can be reduced remarkably.

Because of the described disadvantages in the process implementation lots of operation states occur, during which the sorptive air conditioning plant delivers only an insufficient or even not any cooling capacity.

A further disadvantage of usual sorptive air conditioning systems (desiccant systems employing rotors) is the requirement of two rotating components (wheels SR and WR). This construction causes high cost and furthermore unavoidably a mixing of the air streams occurs. For the above mentioned reasons such type of systems are not economically competitive, at least at low capacity (i.e. size).

The main aim of this invention is to realise an equipment where a cooled sorption process of a component from a gas mixture on a solid sorption material takes place. The equipment should make possible to reach high efficiencies and to achieve low costs even for small size devices.

Another aim of the present invention is to realise an air conditioning or climatization apparatus presenting high efficiency, which is employing the equipment where takes place a cooled sorption process of a component from a gas mixture on a solid sorption material. The apparatus will then present low costs and result economically convenient for small air volume flow (i.e. low capacity of the apparatus).

Another aim of the present invention is to realise an air conditioning or climatization apparatus, which can be employed, for example as unitary system (i.e. not centralised) in particular as alternative to unitary air conditioning systems based on vapour compression chillers.

It is among the aims of this invention to provide a sorptive process of a component from a gas mixture on a solid sorption material and in particular the cooled sorption process of water vapour from an air stream on a solid sorption material.

The above mentioned and other aims of the present invention are reached by the sorptive heat exchanger and related cooled sorption process according to the independent claims.

The sorptive heat exchanger according to the invention, includes a heat exchanger, which consists of a plurality of separated channels which are in thermal contact and in part of them a sorption material is fixed. According to the invention the sorption material is fixed on the internal surface of part of the channels.

The characteristics and the advantages of the equipment where cooled sorption process of component from a gas mixture on a solid sorption material takes place, according to the present invention, will result more clear from the following description, illustrative and not restrictive, referred to the schematic drawings attached hereto, in which.

As schematically shown in FIGS. 2 to 8, a sorptive heat exchanger E includes at least two separated systems of channels in thermal contact.

The heat exchanger, preferably a cross-counter-flow heat exchanger or a counter-flow heat exchanger presents a plurality of heat exchange channels 10 in thermal contact with respective sorption channels 11. The sorption material 12 is fixed on the internal surface of each of the sorption channels 11.

Figure 1:
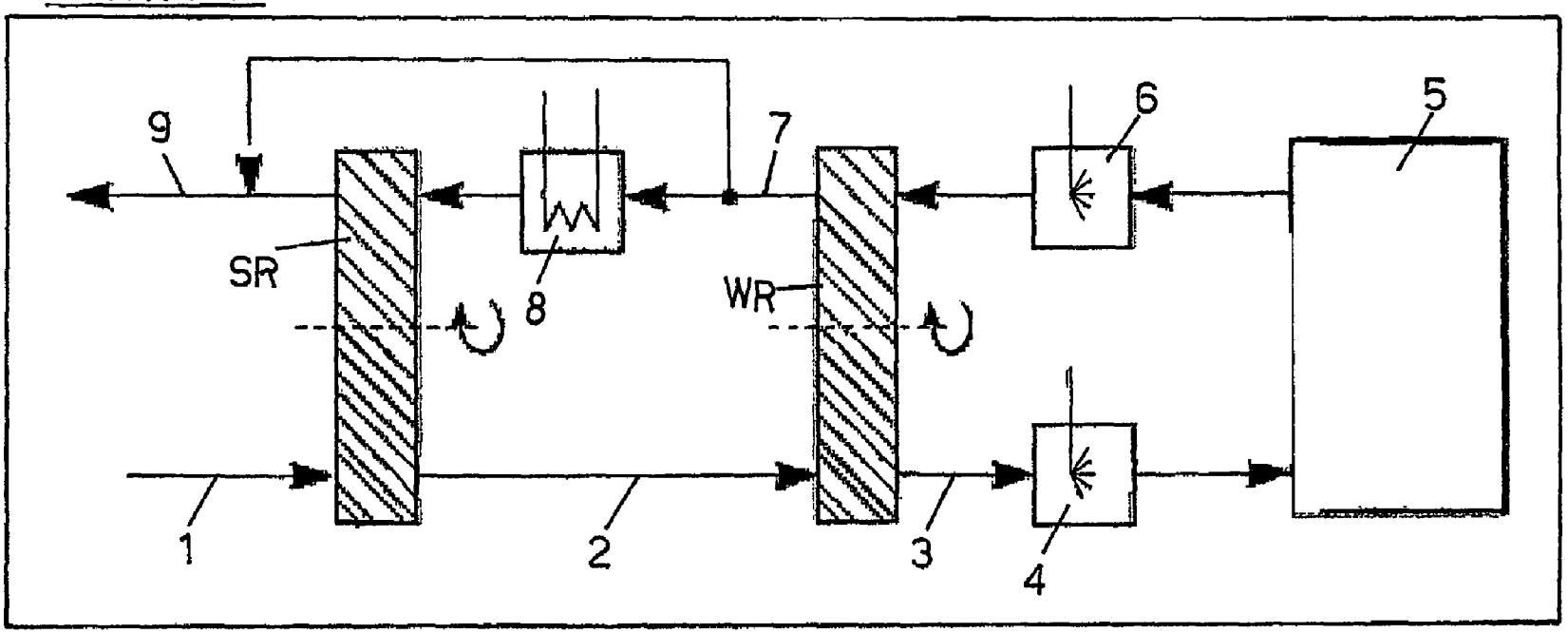
Fig.1 PRIOR ART
FIG. 1 shows a schematic view of a an air conditioning plant according to prior art.
Figure 2:
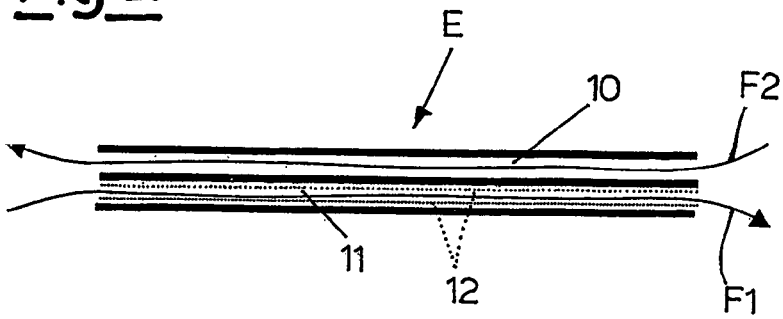
FIG. 2 is a schematic simplified view of part of the sorptive heat exchanger according to the invention.

FIG. 2 shows two channels in thermal contact, and the path of the two fluids through a cross-counter-flow heat exchanger E. If for example the heat exchanger would be used for air conditioning purposes the fluids going through the heat exchanger would be air, but the exchanger is also suitable for treating a generic wet gas used in an industrial process from which a liquid or at least a component has to be extracted.

In each heat exchange channel 10 the cooling fluid F2, which for example in case of an air conditioning or climatization apparatus, can be air, flows according to the direction of the arrow, in the sorption channel 11 the gas mixture F1 from where at least a component has to be extracted, which for example in case of an air conditioning or climatization apparatus can be humid hot air, flows from left to right according to the direction of the arrow.

The sorption material 12, is located on the internal walls of the sorption channel 11. The sorption material has to be chosen among the materials which can better serve the realisation, for example in the case of air conditioning proper materials for air dehumidification are Silica-gel, Zeolite and some hygroscope salts like for instance lithium chloride.

If the fluid F2, which flows in channel 10 is a gas, the equipment will include humidifier components 19 for the possible humidification of the fluid F2 before entering the heat exchanger E, for example ultrasonic humidifiers. In a favourable way, it is possible, to install humidifiers 19 in order to humidify substantially continuously the fluid F2 during its passage in the channels 10.

In this way the fluid is over-saturated or this air is continuously humidified during its way through the heat exchanger channel such that evaporation takes place as soon as the air takes up heat and thereby cooling capacity is provided continuously. This is done, for example, by means of injectors installed at entrance section or inside the channel 10.

Figure 3:
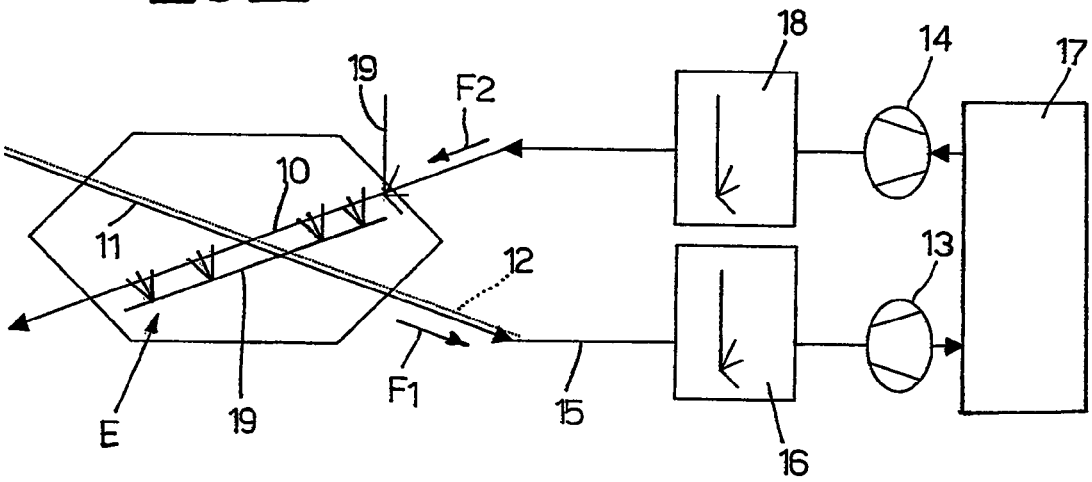
FIG. 3 is a schematic view of an air conditioning apparatus including the equipment according to the invention.

FIG. 3 shows a sorption air conditioning apparatus, realised using the sorptive exchanger according to the present invention.

In the operation during sorption phase (i.e. cooling), ambient air flows, according to arrow of fluid F1, in the sorption channel 11 along regenerated sorption material 12 and is thereby dehumidified. The heat which is thereby created is to a large extent taken up from the cool air in the heat exchanger channel 10. In a favourable way the air in the heat exchanger channel 10 is over-saturated or this air is continuously humidified during its way through the heat exchanger channel such that evaporation takes place as soon as the air absorbs heat and thereby cooling capacity is provided continuously during the passage in channel 10. After the air leaves the sorption channel by means of a channel 15 the air is relatively cold and dry. Optionally the air is further cooled by means of humidification in the humidifier 16 and afterwards it is conducted to the air conditioned interior building 17, by means of the fan 13. Room air is taken from the interior building, by means of the fan 14, and further humidified in the humidifier 18, this time preferably up to over-saturation. Then the air is conducted to the heat exchanger channel 10. In the heat exchanger channel the air can—by means of a respectively suitable device (humidification device)—be continuously humidified during its way through the heat exchanger channel.

Figure 4:
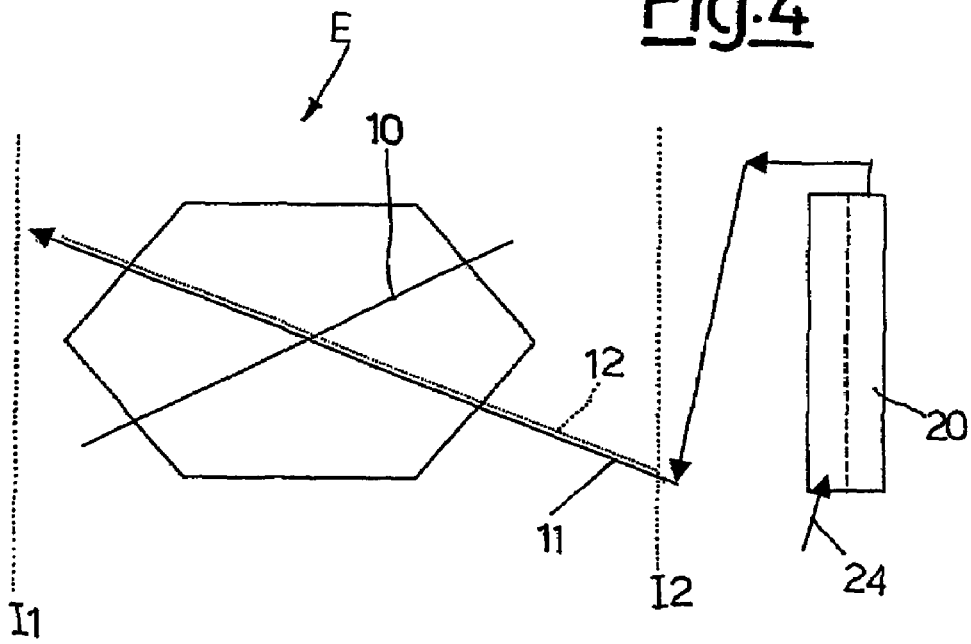
FIGS. 4 to 6 are schematic view of the heat exchanger according to the invention in different regeneration (i.e. desorption of the sorption material) operation modes.
Figure 5:
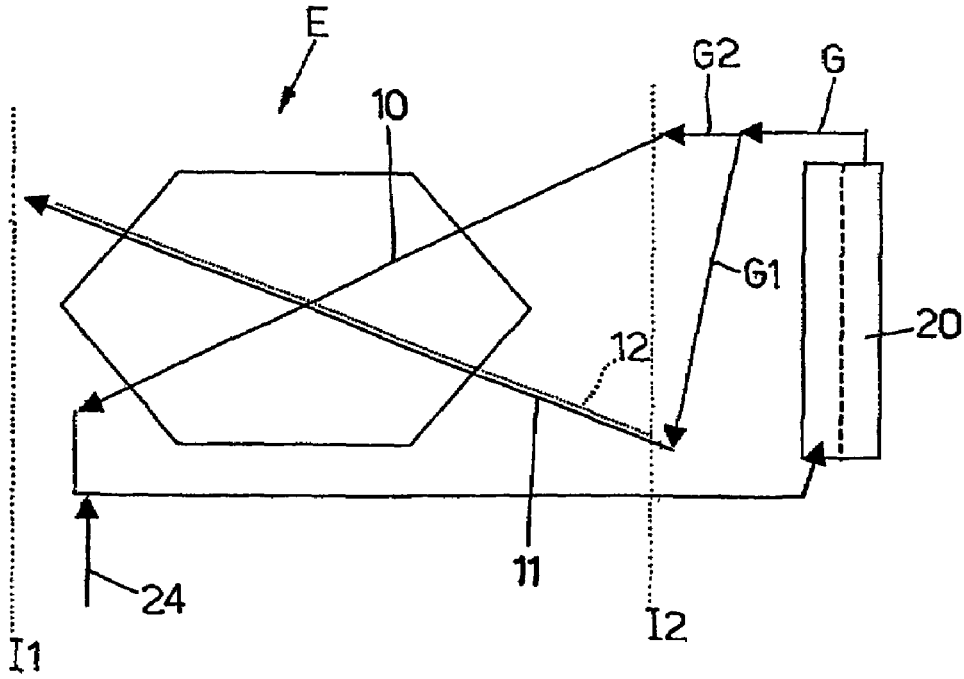
Figure 6:
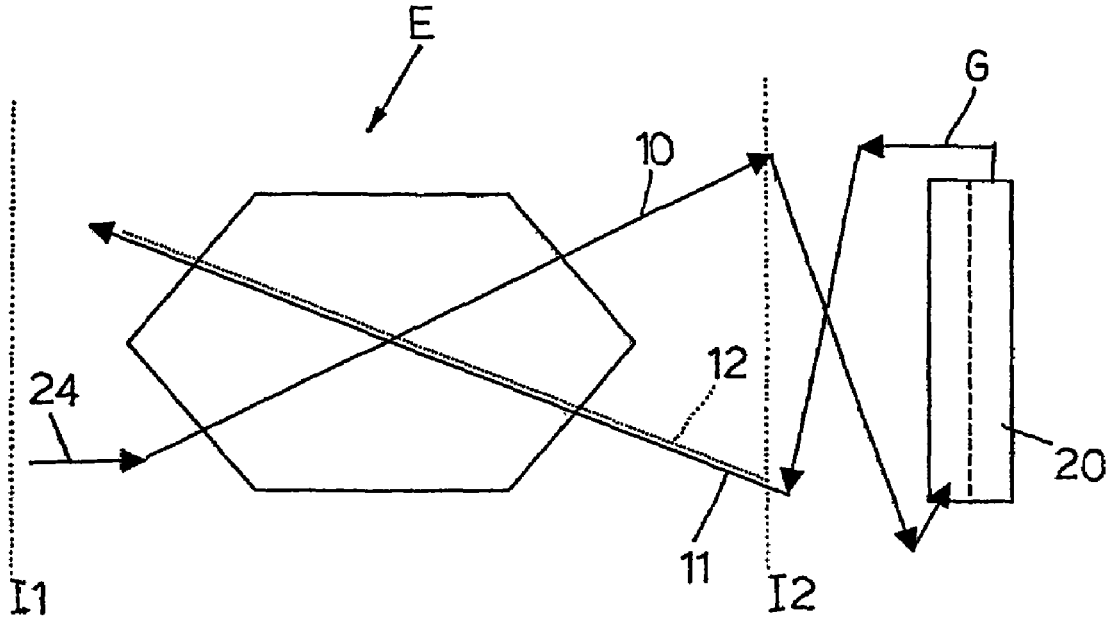

FIGS. 4 to 6 show different methods for the sorption material 12 regenerating phase. In general a wide variety of heat sources can be employed for the regeneration of the sorption material, e.g. waste heat, heat from a district heating system, heat from cogeneration plants or heat from solar thermal collectors. When using heat from a heat source 20, for example solar thermal collectors for desorption the one or other method for desorption is applied depending on the characteristic of the solar collector 20, the type of sorption material 12 and the climatic and meteorological boundary conditions. Another possibility for the desorption of the sorption material 12 (desorption phase) could be to circulate in channel 10 a fluid, preferably close to evaporation condition, for example steam at 100° C. In case of desorption of the sorbens the steam would condense in channel 10 and deliver the energy of condensation for desorption. The condensate preferably could stay in channel 10 and later in the phase of the dehumidification of the gas in channel 11 the occurring sorptive energy would preferably be absorbed by the energy of evaporation of the condensate (the system is similar to heat-pipe systems). In this case the humidifier components 19 would not be necessary.

FIG. 4 shows the most simple way of desorption. Thereby in the heat exchanger E according to a first regenerating method R' in channel 10 there is no fluid blown. Instead the fluid after being heated from the heat source 20 is blown in the sorption channel 11.

In FIG. 5 according to a second regenerating method R" both channel systems, 10 and 11, in the heat exchanger E are flown through in the same direction. The two fluid streams are respectively G1 and G2 and they are previously heated by the heat source 20, for example a solar thermal collector. This variant has the advantage of an improved heat transfer from the fluid to the sorption material 12, since the sorption material is heated from both, the sorption channel 11 and the heat exchanger channel 10 of the heat exchanger E. The heated fluid from the heat exchanger channel 10 is mixed, for example with ambient air 24 and conducted to the heat source 20. Thereby the fluid by means of the heat source 20 reaches higher temperatures, before being used for the desorption process.

Figure 7:
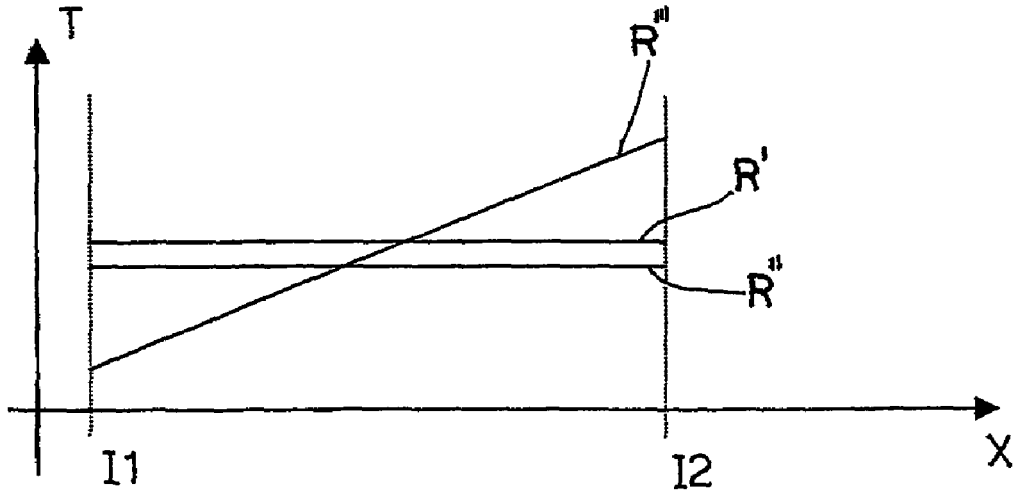
FIG. 7 shows a schematic graph describing qualitatively the trend of temperature in the heat exchanger during the regeneration operation modes according to the FIGS. 4 to 6.

A different third regenerating method R''' of the sorption material is described in FIG. 6. When conducting the process according to FIG. 6 approximately a linear temperature profile will occur during desorption in the heat exchanger E: at the left entrance I1 of the heat exchanger the fluid has a lower temperature and at the right entrance I2 a higher temperature. This distribution means, for example for air conditioning, that the sorption material during operation in cooling mode on the side where the fluid leaves the sorption channel 11 is higher dehumidified. Therefore the air is during the sorption phase during its flow through the sorption channel 11 continuously in contact with a drier sorption material 12, which results in a higher dehumidification potential for the further cooling phase. The absolute value of dehumidification of ambient air can be optimised by the implementation of this process. The desorption methods described in FIGS. 4 and 5 are called "Concurrent Flow Desorption" and the desorption method according to FIG. 6 is called "Counter Flow Desorption". FIG. 7 shows in a qualitative manner the temperature profiles in the sorption channel 11 after desorption phase, according to FIGS. 4, 5, 6 and where the three profiles of the regenerating methods are respectively indicated with R', R'' and R'''. In a first approximation high temperatures mean a high drying of the sorption material 12.

Figure 8:
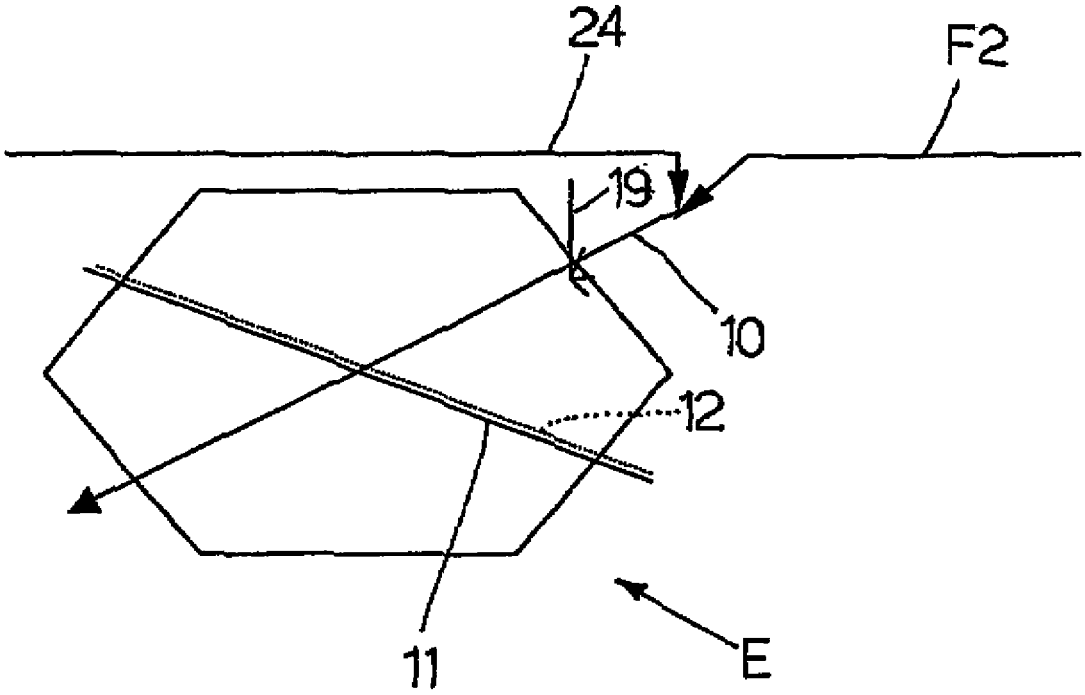
FIG. 8 shows a schematic view of the heat exchanger according to the invention in a pre-cooling operation.

FIG. 8 shows the pre-cooling phase of the heat exchanger E after desorption. The fluid 24, for example for air conditioning applications ambient air, which as desired has been humidified or not humidified or for example room return air F2 which as desired has been humidified or not humidified, is conducted in the heat exchanger channel 10 and takes up the heat from the sorption channel 11, whereby the sorption channel is pre-cooled for the subsequent sorption phase.

A complete cycle of desorption, pre-cooling and sorptive cooling, for example of external ambient air, can be realised by means of subsequent combination of the different operation modes of the devices as in FIGS. 3 to 6 and FIG. 8. If for instance one minute would be available for desorption, in a part of this time desorption can be arranged following the process of FIG. 6 and another part following the process of FIG. 4 and afterwards the heat exchanger could be cooled according to FIG. 8. After this sequence of processes the sorption material 12 in the sorption channel 11 of the heat exchanger shown in the above mentioned figures would be particularly highly dried and well pre-cooled for the subsequent phase of sorption (air cooling). These conditions are favourable for the process.

In order to realise a sorption process after the desorption or regenerating phase follows the sorption phase.

For example for the purpose of air conditioning the cooled sorption process will result in the dehumidification and possibly cooling of the airflow F1 in FIG. 3. The cold and humid air flow F2 in FIG. 3 is responsible for the cooling of the sorption material 12 and consequently of the fluid F1.

Sorption phase and regeneration phase realised by means of desorption are carried out alternately in the equipment, namely the heat exchanger built according to the present invention. For example in air conditioning applications, in order to realise a continuous provision of cold, dehumidified air to the building and for a continuous use of the heat source, e.g. the solar air heating collector and of the humidifiers at least two exchangers, i.e. sorptive heat exchangers, are necessary.

Thereby the two heat exchangers are each time alternately in the operation states "sorption phase" and "regenerating phase". The air streams are diverted depending on the actual operation phase by means of control of respective fluid diverters.

The equipment, according to present invention, if applied for air conditioning would give the chance to achieve higher dehumidification rates and air temperature reductions in comparison with other sorption air conditioning apparatus employing solid sorption material, avoiding any possibility of mixing of the exhaust—i.e. coming from the building—stream and process air.

In comparison to a conventional sorption air conditioning apparatus the construction incorporating the heat exchanger according to the invention is able to achieve a higher air dehumidification and a higher temperature decrease of ambient air without any mixing between fresh air and room return air.

The invention claimed is:

1. A sorptive heat exchanger including a plurality of heat exchange channels (10) in thermal contact with respective sorption channels (11), characterized in that said sorption channels (11) comprise sorption material (12) fixed on their internal surfaces wherein said heat exchange channels (10) are provided for receiving a cooling fluid (F2) and said sorption channels (11) are provided for receiving a fluid (F1) from which at least a component has to be extracted, wherein said sorption material (12) is suitable for the sorption of at least a component of fluid (F1) wherein humidifier components (19) are present for the humidification of the fluid (F2) before it enters the heat exchange channel (10) of the heat exchanger (E).

2. Sorptive heat exchanger according to claim 1, wherein said cooling fluid (F2) is air.

3. Sorptive heat exchanger according to claim 1, wherein said fluid (F1) is wet air and said sorption material (12) is for example silica gel or zeolite or a hygroscope salt like for instance lithium chloride.

4. Sorptive heat exchanger according to claim 1, wherein said humidifier components (19) are provided to humidity the fluid (F2) during its way through the heat exchanger channel (10).

5. Sorptive heat exchanger according to claim 1, wherein said humidifier components (19) used for fluid (F2) humidification during its way through the heat exchanger channel (10) are water injectors installed at the entrance of the channel (10) or inside the heat exchanger.

6. Sorptive heat exchanger according to claim 1, wherein the heat exchanger (E) is arranged such as to perform the desorption of said sorption material (12), by means of a heated fluid that transports heat from the heat source (20) selected from the group consisting of heat from a district heating system, heat from cogeneration plants and heat from solar thermal collectors.

7. Sorptive heat exchanger according to claim 6, wherein the heat exchanger (E) is arranged such as to perform the regeneration of said sorption material (12) by means of steam at 100° C.

8. Sorptive heat exchanger according to claim 6, wherein the heat exchanger (E) is arranged such as to perform the regeneration of said sorption material (12) by means of a fluid close to saturation which flows through the heat exchange channel and that the condensate occurring is staying at the place where it occurs.

9. Device according to claim 1, wherein the heat exchanger (E) is arranged to perform the concurrent flow desorption of the sorption material (12) by means of the heated fluid which flows in channel (11).

10. Sorptive heat exchanger according to claim 1, wherein the heat exchanger (E) is arranged to perform the concurrent flow desorption of the sorption material (12) by means of the heated fluid (G,G1,G2) which flows in channels (10) and (11) in the same direction.

11. Sorptive heat exchanger according to claim 1, wherein the heat exchanger (E) is arranged to perform the counter flow desorption of the sorption material (12) by means of the heated fluid (G) which flows first in the heat exchange channels (10) then is heated by the heat source (20) and then is blown in sorption channels (11).

12. Sorptive heat exchanger according to claim 1, wherein said heat exchanger (E) is arranged such as to perform a pre-cooling following desorption, by means of a fluid (24) conducted in the heat exchanger channel (10) and taking up the heat from the sorption channel (11).

13. Air conditioning or climatization apparatus including the sorptive heat exchanger according to claim 1.

14. Air conditioning or climatization apparatus according to claim 13, including two heat exchangers, two humidifiers, two additional humidifiers for humidification in the heat exchanger channel (10), a heat source, an air valves and a respective control device.

15. Process of cooled sorption of at least a component from a gas mixture (F1) on a solid sorption material by means off the sorptive heat exchanger according to claim 1.

16. Process according to claim 15, wherein said fluid (F1) is air.

17. Process according to claim 15, wherein the sorption and desorption phases including pre-cooling phase are carried out in a timewise sequence.

18. Process according to claim 15, wherein two heat exchangers are employed, whereby each time one of the heat exchangers is operated in the sorption phase, while the other heat exchanger is being desorbed or is pre-cooled for the subsequent sorption phase, respectively.

19. Sorptive heat exchanger according to claim 1, wherein said humidifier components (19) are in form of ultrasonic humidifiers or water injectors for the humidification of the cooling fluid (F2) before it enters the heat exchange channel (10) of the heat exchanger (E).

* * * * *